United States Patent [19]

Prusak

[11] 4,385,978

[45] May 31, 1983

[54] CATHODE HEAD

[75] Inventor: John J. Prusak, Indianapolis, Ind.

[73] Assignee: RCA Corporation, New York, N.Y.

[21] Appl. No.: 302,151

[22] Filed: Sep. 14, 1981

[51] Int. Cl.[3] ..... C25D 1/10; C25D 17/06

[52] U.S. Cl. ..... 204/281; 204/5; 204/292; 204/297 R; 204/DIG. 7; 204/290 F

[58] Field of Search ..... 204/281, 297 R, 5, DIG. 7, 204/224 R, 297 W, 292, 290 F

[56] References Cited

U.S. PATENT DOCUMENTS

| | | | |
|---|---|---|---|
| 2,018,471 | 10/1935 | Russell | 204/281 X |
| 2,675,348 | 4/1954 | Greenspan | 204/5 X |
| 3,414,502 | 12/1968 | Porrata et al. | 204/281 |
| 4,259,166 | 3/1981 | Whitehurst | 204/279 |
| 4,309,265 | 1/1982 | Prusak | 204/281 X |
| 4,341,613 | 7/1982 | Prusak et al. | 204/297 R X |

*Primary Examiner*—Donald R. Valentine

*Attorney, Agent, or Firm*—Birgit E. Morris; Edward J. Sites

[57] ABSTRACT

An improved cathode head is disclosed for electroforming record matrixes. The cathode head includes a conductive cathode plate which is of approximately the same diameter as the matrix to be electroplated so that electrical contact is made to substantially the entire diameter of the matrix during electroforming.

3 Claims, 4 Drawing Figures

Fig. 1. (PRIOR ART)
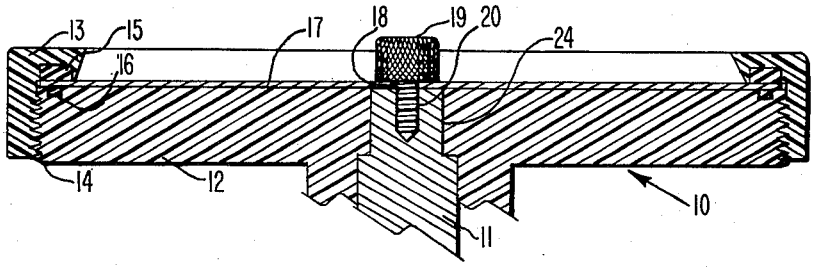
Fig. 2.
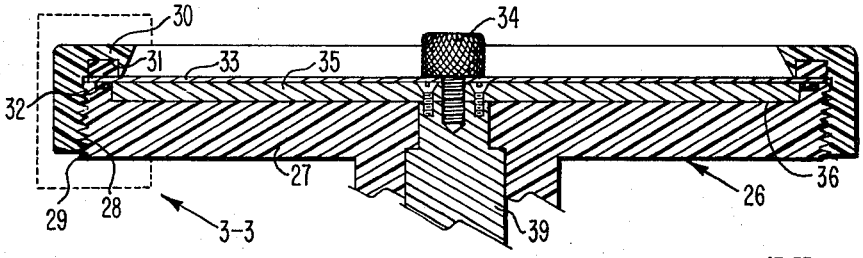
Fig. 3.
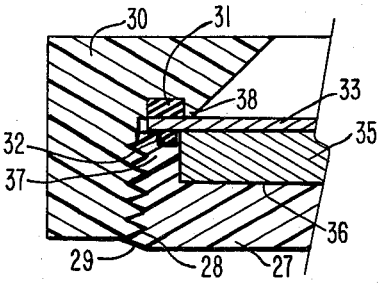
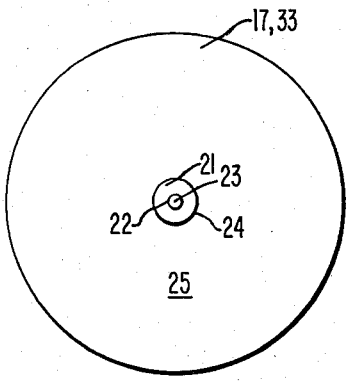
Fig. 4.

CATHODE HEAD

This invention relates to an improved cathode head for use in electroforming of record masters, molds, and stampers, and more particularly is concerned with a cathode head which has improved electrical conductivity.

BACKGROUND OF THE INVENTION

Molded records, such as conventional audio records and the more recently developed video records, are manufactured by the same general procedures. The initial step in the procedures is to record the signal information desired to be molded into the records onto a magnetic tape. The magnetic tape is then used to control a cutting tool which cuts a spiral groove into an appropriate substrate. The spiral groove is cut with surface relief patterns on either the side walls or the base of the grooves which correspond to the information desired to be molded into the final record.

Once the recorded substrate is obtained, it is used as a pattern from which to make a series of parts referred to as masters, molds, and stampers. The initial step is the preparation of the masters. The masters are made by electroforming a metal, such as nickel or silver, onto the recorded grooved surface of the recorded substrate. Once a sufficient amount of metal is electroformed on the recorded substrate to make the self-supporting part, which typically is about 7 mils (0.0175 centimeter) of metal, the electroformed master is stripped from the recording substrate. The master which is thus obtained will be a negative image of the recorded substrate.

The grooved surface of the master is then used as a matrix on which to form a series of replicas referred to as molds. The molds are made by electroforming a metal such as nickel onto the master until sufficient metal has been deposited to make a self-sustaining part, which typically is about 7 mils (0.0175 centimeter) in thickness. From a given master a number of molds will be made. The resulting molds will be positive copies of the recording substrates and negative copies of the master.

Each of the molds is then in turn used as a matrix on which to electroform a series of parts referred to as stampers. The stampers are also formed from a metal such as nickel and are generally about 5 mils (0.0129 centimeter) in thickness. Stampers are negative copies of the original recorded substrate. It is the stamper which will eventually be used as the molding surface with which to press the surface relief pattern into the molded records.

In the manufacture of molded records, it is extremely important to "fan out" from the starting master to form a plurality of molds and then fan out from the molds to form a plurality of stampers. The cutting of the recording into the substrate is a relatively costly and time consuming step. If each of the stampers had to be made directly on a recorded substrate, the cost of the records would be extremely high. In addition, the ability to fan out from a given master to produce, for example 40 or 50 stampers, improves the uniformity from record to record of the recordings which are pressed.

Considerable problems are, however, encountered in the replication process used to form the molds and stampers from the masters. As noted above, the required parts are prepared by electroforming metal on the masters to form the molds and then on the resulting molds to form the stampers. In the electroforming process, the matrix to be replicated is attached to a cathode head and then immersed in an electroplating bath. A current is passed through the matrix to be replicated, which causes the metal from the electroplating bath to be deposited on the matrix and form the replica. Ideally, the metal should be deposited in a uniform thickness on the matrix without adversely affecting the matrix. In actual practice, however, substantial problems are encountered which result in formation of poor replicas having non-uniform plating and areas of high crystallinity, a condition referred to a "treeing". An even more serious problem, however, is encountered which is referred to as "burn outs". A burn out occurs when, apparently due to poor electrical contact, the matrix and the part to be formed on the matrix are heated up and eventually melt down or burn out. The burn out of the parts results in destroying both the matrix and the part formed on the matrix. If the matrix part is a master, it can be seen that this causes serious problems as it both destroys the part and eliminates the fan out production of parts from the master. If a mold is destroyed as a result of burn out, the amount of stampers which can be made is reduced because of the destruction of the mold.

A still further problem encountered in the electroplating process is referred to as "back plating" wherein the electrolyte leaks to the back of a matrix being replicated and deposits on the back rather than the face of the matrix. This damages the matrix and may also contribute to the burn out problems.

One of the most important pieces of apparatus used in the matrixing process is the cathode head. The cathode head is the apparatus on which the matrix to be duplicated is mounted for the electroforming process. The cathode head typically used in the prior art has a case or support made of a dielectric material, such as rubber or a non-conductive plastic, on which the matrix is mounted with electrical contact being made at the centermost portion of the matrix to the cathode of the electroplating apparatus.

It is also suggested in the prior art to use cathode heads having rubber backs and internal edge shields to hold the matrix to the cathode during electroforming. Such a combination of cathode head and edge shield is disclosed by L. R. Porratta et al. in U.S. Pat. No. 3,414,502, issued Dec. 3, 1968, entitled *ELECTROPLATING APPARATUS FOR USE WITH A PHONOGRAPH RECORD MATRIX*. Apparatus such as that disclosed by L. R. Porratta et al. has disadvantages in that they tend to allow leakage of electrolyte about the edges of the matrix to the back side of the matrix which is a highly undesirable condition, and burn outs are frequently encountered with this type of apparatus.

It is also suggested in the prior art that resilient edge shields be placed around the outer edges of the matrix before starting plating of the matrix. However, the prior art rubber edge shields are at best only marginally satisfactory when the shields are relatively new. When the edge shields are new and are applied correctly by skilled operators, reasonably satisfactory results can be obtained with regard to preventing electrolyte leakage. However, after the edge shields are used a few times, they tend to stretch and allow leakage of electrolyte. Furthermore, if the operators are not careful and do not apply the shields correctly, a substantial amount of leakage of electrolyte does occur about the outer edges of the shield resulting in undesirable back plating and possibly burn outs.

Another device suggested in the prior art to improve the quality of plating when making molds and stampers and the like for the manufacture of records is disclosed by Whitehurst in U.S. Pat. No. 4,259,166, issued Mar. 31, 1980, entitled *SHIELD FOR PLATING SUBSTRATES*. Whitehurst provides a masking apparatus which has certain distinct advantages over the prior art, but still has the disadvantage that it is both difficult to assemble and sometimes problems are still encountered in separating the electroformed part from the matrix, and burn outs are often encountered during manufacture of parts on the cathode head.

An additional improved apparatus for use in electroforming record matrixes is disclosed in the co-pending application by Prusak et al. in U.S. patent application Ser. No. 231,266, filed Feb. 3, 1981, now U.S. Pat. No. 4,341,613, entitled *APPARATUS FOR ELECTROPLATING*. The apparatus disclosed by Prusak et al. is a cathode head assembly including an outer ring member and seals which improve the quality of the electroforming parts formed on the apparatus. The apparatus disclosed by Prusak et al. has proven to be a significant improvement in the electroforming art with regard to preventing leakage of electrolyte to the back surface of the matrix and for providing replicas which can easily be separated from a matrix. However, the cathode head which is disclosed by Prusak et al., while a substantial improvement, still is not completely satisfactory and a considerable amount of burn outs are still encountered with this type of apparatus. What would be highly desirable would be a cathode head which would be easy to assemble and which when used in the electroforming operation would produce high-quality replicas which are easy to separate from the matrix and which would prevent leakage of the electrolyte to the back of the matrixes and which would eliminate the burn out problems during electroforming.

BRIEF SUMMARY OF THE INVENTION

An improved cathode head is provided in accordance with this invention which has an outer case made of a dielectric material in which a cathode plate is positioned of approximately the same diameter as the matrix to be electroplated, so that electrical contact is made with substantially the entire back surface of the matrix during electroforming.

BRIEF DESCRIPTION OF THE DRAWINGS

FIG. 1 is an illustration in partial cross-section of a cathode head of the type disclosed in the Prusak et al. reference noted above.

FIG. 2 is an illustration in partial cross-section of a cathode head of this invention.

FIG. 3 is an enlarged illustration of the edge portion of the cathode head of this invention taken as indicated by the dotted lines and arrow 3—3 in FIG. 2.

FIG. 4 is a composite illustration showing the relative areas of electrical contact obtained with the prior art apparatus and that of the present invention.

DETAILED DESCRIPTION OF THE INVENTION

In order to more clearly point out the features of the cathode head of the present invention, reference will initially be made to the apparatus heretofore disclosed in the Prusak et al. application (the disclosure of which is incorporated herein by reference) in order to establish a basis for comparison.

In FIG. 1 there is illustrated a cathode head of the type disclosed in Prusak et al., U.S. patent application Ser. No. 231,266 entitled *APPARATUS FOR ELECTROPLATING*. The apparatus 10 of the Prusak et al. application is illustrated secured to a cathode 11. The apparatus consists of a flat disc 12 made of a dielectric material and an outer ring 13 which screws onto the outer edge 14 of the flat disc and a pair of opposing seal members 15 and 16 in the outer ring 13 and the flat disc 12, respectively. A matrix 17 to be replicated is shown mounted on the cathode head 10. The matrix 17 is held in liquid-tight contact by the seal members 15 and 16 when the outer ring 13 is tightened. Electrical connection of the matrix 17 to the cathode 11 is made at the center hole area 18 by tightening the cathode knob 19 onto the stud 20 which extends from the cathode 11.

As can best be seen in FIG. 4, the total area of electrical contact 21 extends only from the edge 22 of the center hole 23 to the outer diameter 24 of the cathode 11. The total area of electrical contact 21 is relatively small compared to the total surface area 25 of the entire matrix 17. The requirements for electroforming, however, require that a relatively uniform distribution of current be made over the entire surface area of the matrix. In practice, however, a relatively large amount of current must be introduced through the relatively small area of the matrix which is an actual electrical contact with the cathode, and this results in relatively high current densities in the area 21. The problems of high current density are further compounded by the fact that the matrixes are relatively thin, being typically about 7 mils (0.0175 centimeter) in thickness, and accordingly there is a limited amount of current carrying capacity in the portion of the matrix in electrical contact with the cathode 11.

It was found that because of the minimal contact area 21 of the prior art cathode head and the resulting current density conditions that are encountered in this area 21, that minor surges in current and changes in the amount of resistivity at the contact area 21 can and often do result in sudden and rapid rises in the temperature of the matrix and the replica which in turn results in a burn out.

The cathode head of this invention 26 is similar in certain aspects to the apparatus illustrated in FIG. 1. The cathode head 26 has a flat, disc-shaped support member 27, which has a thread 28 on its outer diameter 29. A threaded lock ring member 30 is threadably engaged with the thread 28 on the edge 29 of the flat disc 27. There is an upper seal member 31 positioned in the threaded lock ring 30 and a lower seal member 32 in opposing relationship in the flat disc 27. The seals are positioned so as to hold the matrix 33 in a liquid-tight seal at the edge of the matrix 33.

A cathode knob 34 is preferably used to hold the matrix 33 in liquid-tight engagement at the center of the matrix 33. It should be noted, however, that because of the improved electrical contact made with the cathode head of this invention 26 that it is possible to eliminate the use of the cathode knob 34 and simply seal the center hole with conductive material and plate the entire exposed surface of the matrix.

The cathode head 26 of the present invention differs from that of the prior art apparatus 10 described above with regard to the method of making electrical contact with the matrix 33. In the cathode head of this invention 26 a cathode plate 35 is positioned within a cavity 36 which is defined in the flat disc-shaped member 27. The cathode plate is also a disc-shaped member which is preferably of a diameter which is slightly smaller than the matrix 33 which is to be duplicated, and the same or slightly larger than the replica to be formed on the matrix. The cathode plate 35 is made of electrically conductive material. The cathode plate 35 is preferably formed from a metal which is relatively passive in the electroplating process. Suitable metals include, for example, stainless steel, passivated nickel, and even more preferably titanium. The thickness of the cathode plate 35 is an important consideration. The cathode plate must be sufficiently thick so as to be able to carry the current at a sufficiently low current density so as to prevent burn outs. Furthermore, the cathode plate 35 should also have sufficient thickness so as to effectively act as a heat sink in the event areas of high resistivity are encountered. This is an important feature of the present invention in that it results in heat being carried away rather than accumulating in a small area and resulting in a burn out. The minimum thickness is to some extent dependent upon the electrical conductivity of the metals employed, but it has been found that optimum results are obtained when a metal plate about $\frac{1}{8}$ inch (0.3175 centimeter) in thickness is used, as this provides both an adequate margin of safety with regard to electrical conductivity and also an adequate amount of rigidity to the cathode plate 33 so it remains flat during the electroforming operation. The maximum thickness of the cathode plate is not critical and is only limited by practical considerations.

The cathode plate has a configuration which is designed to mate with the configuration of the cavity 36 defined in the flat disc-shaped member. In use the cathode plate is positioned within the cavity 36 in the flat disc-shaped member. The cathode plate has a flat face surface for receiving the matrix 33 when it is placed on the cathode head 26. About the outer edge of the cavity 36 there is a raised edge portion 37 in which there is positioned the lower seal member 32. This is the preferred embodiment of the apparatus of the present invention in that the lower seal member in cooperation with the upper seal member 31 prevents electrolyte from leaking to the cathode plate 35 when the cathode head is immersed in the electrolytic bath for electroforming.

The diameter of the cathode plate and the cavity 36 in which it is placed are preferably slightly larger than the inside diameter 38 of the threaded lock ring 30, so that when the outer ring 30 is tightened onto the flat disc 27, the matrix 33 is forced into contact with the cathode plate 35 about the outer diameter of the cathode plate. This is an especially desirable feature in that it ensures good electrical contact around the outer diameter of the matrix 33.

The cathode plate 35 is preferably secured at the center portion thereof to the cathode 39. The connection can be made by various means which provide good electrical contact of the cathode plate 35 and the cathode 39. One method of making the contact which has proven to be suitable is to coat the back side of the cathode plate 35 and the end of the cathode 39 with a conductive coating such as silver paste and then attach the cathode plate 35 to the cathode with mechanical fasteners such as screws or the like to provide what is in effect a one piece unit comprised of the cathode plate 35 and the cathode 39 with regard to the electrical conductivity.

In use, the initial step in employing the cathode head 26 of this invention is to secure the matrix 33 to the cathode head 26. The matrix 33 is secured to the cathode head by initially removing the lock ring 30 and the cathode knob 34 from the flat disc-member 27. The matrix 33 is then placed on the flat face surface of the cathode plate 35 and is examined to make sure that it is centered and lying flat on the cathode plate 35. The matrix 33 then can be secured on the cathode plate 35 with the cathode knob 34 and the cathode knob is tightened until a liquid-tight seal is obtained at the center portion of the matrix. The threaded lock ring 30 is then applied and tightened until the seal members 31 and 32 engage the outer diameter of the matrix in a liquid-tight seal. The cathode head 26 is now ready for immersion into the electroplating bath. The cathode head of this invention can then be used in essentially the same manner as the conventional cathode heads disclosed in the prior art with regard to the rate of plating and the amount of current applied during the plating process.

Referring again to FIG. 4, it can be seen that the matrix 33 will be in electrical contact with the cathode plate 35 from the edge 22 of the center hole 23 for almost the entire diameter of the matrix. Furthermore, the entire area of the matrix to be plated, that is the area inside the seal members 31 and 32 and the inner edge 38 as illustrated, is in electrical contact. It has been found that with the cathode head of this invention this improved area of contact substantially improves the uniformity of electrical contact across the entire matrix area and substantially reduces the current density across the entire matrix. It has been found that, utilizing the cathode head of this invention 26, burn outs are not encountered. Furthermore, the uniformity of the plating is substantially improved. In addition, because of the improved electrical conductivity properties of the cathode head 26 of this invention, it is also possible to increase the current during plating and thereby increase the plating rate if desired.

What is claimed is:

1. A cathode head for holding a flat record matrix of a first diameter during electroforming of a replica of a second diameter on the surface of the matrix, said cathode head comprising in combination: a disc shaped support member, a cathode plate, and a lock ring member, said support member being made of a dielectric material and being of a diameter at least as large as said first diameter and having a circular cavity defined in a face thereof having a diameter of at least the second diameter but less than the diameter of the support member, said cathode plate being a disc-shaped member comprised of an electrically conductive material selected from the group consisting of stainless steel, nickel, and titanium and being of a thickness sufficient to reduce the current density during electroforming a replica on the matrix so as to prevent burn outs of said matrix during electroforming, said cathode plate further having a flat face portion and a configuration which mates with the configuration of said cavity, said cathode plate being positioned within said cavity with the flat face portion positioned so as to receive said matrix; said lock ring member being made of a dielectric material and having means for engaging and locking in a liquid-tight seal on the outer edge of said disc-shaped member and having an inner diameter of said second diameter whereby when a matrix is placed on the flat faced portion of the cathode plate and the lock ring member is engaged and tightened on the disc-shaped member the matrix is forced into liquid-tight electrical contact with the cathode plate.

2. The cathode head according to claim 1 wherein the cathode plate is made of titanium.

3. The cathode head according to claim 1 wherein the cathode plate is at least about $\frac{1}{8}$ inch (0.3175 centimeter) thick.

* * * * *